US011161161B2

(12) United States Patent
Holzweber et al.

(10) Patent No.: US 11,161,161 B2
(45) Date of Patent: Nov. 2, 2021

(54) METHOD FOR ROLLING A PRODUCT TO BE ROLLED

(71) Applicant: Primetals Technologies Austria GmbH, Linz (AT)

(72) Inventors: Matthias Holzweber, Langschlag (AT); Konrad Krimpelstaetter, Gallneukirchen (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 176 days.

(21) Appl. No.: 16/094,911

(22) PCT Filed: Apr. 28, 2017

(86) PCT No.: PCT/EP2017/060193
§ 371 (c)(1),
(2) Date: Oct. 19, 2018

(87) PCT Pub. No.: WO2017/186910
PCT Pub. Date: Nov. 2, 2017

(65) Prior Publication Data

US 2019/0151919 A1 May 23, 2019

(30) Foreign Application Priority Data

Apr. 29, 2016 (EP) ..... 16167662

(51) Int. Cl.
*B21B 37/44* (2006.01)
*B21B 27/10* (2006.01)
(Continued)

(52) U.S. Cl.
CPC ..... *B21B 37/44* (2013.01); *B21B 27/10* (2013.01); *B21B 37/32* (2013.01); *B21B 45/0251* (2013.01)

(58) Field of Classification Search
CPC ... B21B 37/32; B21B 37/44; B21B 2027/103; B21B 27/10; B21B 45/0218; B21B 45/0251
See application file for complete search history.

(56) References Cited

U.S. PATENT DOCUMENTS 6,497,127 B2 * 12/2002 Nishiura ..... B21B 45/0251 72/44
7,434,435 B2 10/2008 Richter ..... 72/236
(Continued)

FOREIGN PATENT DOCUMENTS

CN 1845803 A 10/2006
CN 1931459 A 3/2007
(Continued)

OTHER PUBLICATIONS

J.B.A.F. Smeulders, "Lubrication in the Cold Rolling Process Described by a 3D Stribeck Curve," AISTech 2013 Proceedings, pp. 1681-1689.
(Continued)

*Primary Examiner* — Shelley M Self
*Assistant Examiner* — Jared O Brown
(74) *Attorney, Agent, or Firm* — Ostrolenk Faber LLP

(57) ABSTRACT

A method for rolling a product to be rolled (3), wherein the product (3) is fed through a rolling gap (11) between two working rollers (9, 10) of a roll stand (1) and a cooling lubricant is introduced into a contact zone (15, 16), in which a contact surface (17, 18) of the product to be rolled (3) lies against a working roller (9, 10), in order to lubricate the contact zone (15, 16). Furthermore, a lubrication demand of the contact zone (15, 16) is determined in accordance with at least one process parameter of the rolling process and an additional lubricant is applied to the contact surface (17, 18) of the product to be rolled (3) before the rolling gap (11) at a specified application distance (D) if a cooling lubricant
(Continued)

amount (C) presently introduced into the contact zone (15, 16) does not cover the lubrication demand. The application distance (D) is sized such that adhesion of the additional lubricant to the contact surface (17, 18) is increased and the lubricating effect in the contact zone (15, 16) is improved in comparison with application immediately before the rolling gap (11). In addition, the lubricant amount (C) introduced into the contact zone (15, 16) is reduced if additional lubricant is applied to the contact surface (17, 18).

11 Claims, 3 Drawing Sheets

(51) Int. Cl.
*B21B 37/32* (2006.01)
*B21B 45/02* (2006.01)

(56) References Cited

U.S. PATENT DOCUMENTS

| | | | | |
|---|---|---|---|---|
| 7,472,574 | B2 | 1/2009 | Pawelski et al. | 72/201 |
| 2002/0121118 | A1 | 9/2002 | Nishiura | 72/43 |
| 2002/0162374 | A1 | 11/2002 | Plicht | 72/201 |
| 2009/0282884 | A1* | 11/2009 | Pawelski | B21B 37/32 72/201 |
| 2014/0238093 | A1* | 8/2014 | Krimpelstatter | B21B 15/005 72/41 |
| 2014/0322557 | A1* | 10/2014 | Brunnthaler | B21B 1/227 428/606 |
| 2020/0324327 | A1* | 10/2020 | Hirai | B21B 27/10 |

FOREIGN PATENT DOCUMENTS

| | | | |
|---|---|---|---|
| DE | 60030288 | T2 | 10/2007 |
| EP | 0 794 023 | A2 | 9/1997 |
| EP | 2 651 577 | B1 | 1/2015 |
| EP | 1 750 864 | B2 | 1/2016 |
| JP | H01-218710 | A | 8/1989 |
| JP | H08-174035 | A | 7/1996 |
| JP | H11-244925 | A | 9/1999 |
| JP | 2000-280002 | A | 10/2000 |
| JP | 2001-321809 | A | 11/2001 |
| JP | 2002-282926 | A | 10/2002 |
| JP | 2005-193242 | A | 7/2005 |
| JP | 2006-224141 | A | 8/2006 |
| JP | 2006-263772 | A | 10/2006 |
| JP | 2006-263800 | A | 10/2006 |
| JP | 2007-160367 | A | 6/2007 |
| JP | 2009-142842 | A | 7/2009 |
| JP | 2011-200877 | A | 10/2011 |
| RU | 1795920 | A3 | 2/1993 |
| RU | 2008 112 666 | A | 10/2009 |
| RU | 2372162 | C2 | 11/2009 |
| SU | 1015941 | A | 5/1983 |
| WO | WO 00/64605 | A1 | 11/2000 |
| WO | WO 2005/120739 | A1 | 12/2005 |
| WO | WO 2007/025682 | A1 | 3/2007 |
| WO | WO 2013/029886 | A1 | 3/2013 |
| WO | WO 2013/120750 | A1 | 8/2013 |

OTHER PUBLICATIONS

Handbuch Umformen, ("Manuel of Forming") 2nd Edition, Chapters 3.1.2.1.2 and 3.1.2.1.3, 2012, ISBN 978-3-446-42778-5, and its English translation of fhe relevant portions.

Japanese Office Action, dated Mar. 2, 2020, issued in corresponding Japanese Patent Application No. 2018-556441. Include English translation. Total 13 pages.

Chinese Office Action, dated Sep. 3, 2019, issued in corresponding Chinese Patent Application No. 201780026643.5. Includes English translation. Total 19 pages.

European Oral Proceeding, dated Jun. 21, 2021, issued in corresponding European Patent Application No. 17 723 941.5. Total 10 pages.

* cited by examiner

METHOD FOR ROLLING A PRODUCT TO BE ROLLED

CROSS-REFERENCE TO RELATED APPLICATIONS

The present application is a 35 U.S.C. §§ 371 national phase conversion of PCT/EP2017/060193, filed Apr. 28, 2017, which claims priority of European Patent Application No. 16167662.2, filed Apr. 29, 2016, the contents of which are incorporated by reference herein. The PCT International Application was published in the German language.

BACKGROUND OF THE INVENTION

The invention relates to a method for rolling, in particular for cold rolling, a rollable material. The rollable material is guided through a rolling gap between two working rollers of a roll stand, and a contact zone, in which a contact surface of the rollable material contacts a working roller and is lubricated.

The rollable material is a metallic rolled strip which the rotating working rollers draw through the rolling gap to reduce the thickness of the rolled strip. Lubricating a contact zone in which the rollable material is in contact with a working roller reduces friction between the rollable material and the working roller. In order for the temperature and the wear on the working rollers to reduce, the working rollers are typically cooled. Various methods and devices for lubricating contact zones in which a rollable material is in contact with working rollers are known.

EP 2 651 577 B1 discloses a method for applying a lubricant when rolling a metallic rolled strip in a rolling gap wherein the strip is guided between two working rollers. A mixture of the lubricant and a carrier gas is generated in an atomizing installation. The mixture is applied to the surface of at least one working roller and/or to the surface of the rolled strip by spray nozzles.

WO 2013/029886 A1 discloses an operating method for a reversing rolling mill having at least one reversing roll stand for rolling a rollable material and a coil for coiling the rollable material after a rolling pass. A rolling oil application device disposed between the at least one reversing roll stand and the coil herein, exclusively applies rolling oil without water as a carrier medium to the rollable material.

WO 00/64605 A1 discloses a roller assembly having at least one roll stand for rolling a metal strip and a lubricating device, assigned to the roll stand, for applying a quantity of lubricant to the metal strip to be distributed across the width of the metal strip. The lubricating device includes a basic lubricating device and an additional lubricating device. The quantity and the distribution of the lubricant to be applied by the basic lubricating device is constant during a pass, and the quantity and/or the distribution of the lubricant to be applied by the additional lubricating device is able to be set. A lubricating profile across the width of the metal strip is determined behind the roll stand by a lubricating profile detection installation, and the lubricating profile is utilized for setting the quantity and/or the distribution of the lubricant and/or at least one rolling parameter.

EP 1 750 864 B2 discloses a method and a device for cooling and/or lubricating rollers and/or rollable material. A cooling medium is applied from a plurality of nozzles/nozzle rows to the rollers, on the one hand, and a basic oil is applied from the nozzles/nozzle rows to the rollable material for lubrication ahead of the rolling gap, on the other hand, wherein the cooling medium is applied to the rollers separately from the basic oil, and the basic oil exclusively, without water as a carrier medium, in a quantity that is very small in relation to the usual quantity is directly applied to the rollable material across the entire width of the latter.

EP 0 794 023 A2 discloses a rolling mill and a method for cold rolling a rollable material, in which rolling oil is introduced directly ahead of a rolling gap between the rollable material and the working rollers, and cooling water is applied to the working rollers.

WO 2013/120750 A1 discloses a device and a method for lubricating the rollers of a roll stand, wherein by means of a mixing and spraying installation a mixture of water and oil is generated and the mixture is sprayed onto at least one of the rollers of the roll stand and/or onto the surface of the rollable material.

JP H01 218710 A discloses a method for lubricating and cooling a rollable material in a roll stand, in which coolant is applied to the rollers on the outlet side, and a lubricant is applied to the rollers on the inlet side, and wherein additional lubricant can be applied by nozzles onto the rolled strip ahead of the roll stand when required.

According to WO 2007/025682 A1, in a roll stand, lubricant is applied to the working rollers on the inlet side, or is applied directly to the upper side and lower side of the rolled strip, respectively, to achieve improved strip qualities by a more stable rolling process, in particular by adapting the rolling gap friction. The total lubricant quantity applied is controlled by a mathematical model to depend on process data so that only required lubricant for the rolling process is applied.

SUMMARY OF THE INVENTION

The invention is based on the object of specifying an improved method for rolling a rollable material, by guiding the rollable material through a rolling gap between two working rollers of a roll stand, and contact zones in which the rollable material is in contact with the working rollers are lubricated.

The object is achieved according to the invention disclosed herein.

In the method according to the invention for rolling a rollable material, the rollable material in a rolling direction is guided through a rolling gap between two working rollers of a roll stand, and in a contact zone in which a contact surface of the rollable material contacts a working roller. A cooling lubricant is introduced for lubricating the contact zone.

Furthermore, a lubrication requirement of the contact zone is determined, which lubrication requirement depends on at least one process parameter of the rolling process, and in terms of the rolling direction, an additive lubricant is applied to the contact surface of the rollable material ahead of the rolling gap at a predefined application spacing from the rolling gap, when the cooling lubricant quantity currently introduced into the contact zone does not cover the lubrication requirement.

The method thus advantageously enables an additive lubricant for lubricating a contact zone between the rollable material and a working roller to be used in addition to a cooling lubricant when required, in case the cooling lubricant quantity introduced does not enable a sufficient lubrication. The additional lubrication reduces the rolling gap friction between the rollable material and the working roller in the contact zone, and on account thereof, advantageously enables a saving in terms of energy because of a lower drive output required for the working roller. Furthermore, on account of improved lubrication by means of the additive lubricant, the possibility of also rolling rollable material of a higher strength at an acceptable pass reduction rate is created, since increased rolling forces are created when rolling rollable material of higher strength and an increased lubrication requirement is therefore created. As a result, the product range that can be produced by the roll stand is advantageously extended. The flexibility in production can be further increased by a product-dependent and/or process-dependent choice of the additive lubricant used. Moreover, lubrication that is independent of cooling is enabled by the application of the additive lubricant when required.

On account of the additive lubricant being applied to the rollable material at a predefined application spacing ahead of the rolling gap, the additive lubricant moreover acts on the rollable material until the latter reaches the rolling gap. On account of this long dwell time, the lubricating effect (the so-called plate-out) of the additive lubricant in the contact zone is advantageously improved, as compared to an application of the additive lubricant to the rollable material directly ahead of the rolling gap.

The invention provides that the cooling lubricant quantity introduced into the contact zone is reduced when additive lubricant is applied to the contact surface. This takes into account the fact that additive lubricant can be washed off again by the cooling lubricant. It is therefore expedient for the cooling lubricant quantity to be reduced when additive lubricant is being applied, in order to prevent a washing-off effect by the cooling lubricant.

Use of additional lubrication moreover enhances the cleanliness of the rollable material surface, that is it reduces the iron dust that remains on the rollable material after its rolling. The additional lubrication can therefore also be advantageously used for producing rollable material having enhanced requirements in terms of the cleanliness of the rollable material surface.

One design embodiment of the invention provides that the additive lubricant quantity applied to the contact surface of the rollable material is set so as to depend on the lubrication requirement determined for the contact zone. On account of that, the additive lubricant quantity used can advantageously be adapted to the lubrication requirement, such that a lubrication of the contact zone that is sufficient at all times is achieved, on the one hand, and any excessive additive lubricant quantity which would cause slippage of the working roller on the rollable material is avoided, on the other hand.

One further design embodiment of the invention provides that a rollable material speed of the rollable material, and/or a compressive strength of the rollable material, and/or a roughness of the rollable material, and/or a relative speed between the contact surface of the rollable material at a reference location and the surface of the worker roller, and/or a thickness of the rollable material, and/or a viscosity of the cooling lubricant are/is used as process parameters for determining the lubrication requirement.

The use of the rollable material speed as a process parameter for determining the lubrication requirement is particularly advantageous because the rolling gap friction between the rollable material and the working rollers, and thus the lubrication requirement, depend heavily on the rollable material speed. Moreover, the rolling gap friction substantially depends on the compressive strength and the roughness of the rollable material, which is why these material properties of the rollable material are also advantageously suitable as process parameters for determining the lubrication requirement. Moreover, taking into account these material properties of the rollable material advantageously enables a product-specific lubrication of the contact zone in particular.

The relative speed between the contact surface of the rollable material and the surface of the working roller depends on the location at which the speed of the contact surface is observed, since the thickness of the rollable material changes in the contact zone and the contact surface therefore ahead of the rolling gap moves slower than the surface of the working roller and behind the rolling gap moves more rapidly than the surface of the working roller. The relative speed between the contact surface of the rollable material and the surface of the working roller therefore has to relate to a reference location which is fixed in relation to the rolling gap. This relative speed is a measure for the relative movement between the contact surface and the working roller in the contact zone.

This relative movement leads to plastic deformations of the surface microstructure of the rollable material and, on account thereof, influences the distribution of the additive lubricant which adheres to depressions in the contact surface, on account of which the rolling gap friction is in turn influenced. Therefore, the relative speed between the contact surface of the rollable material at a reference location and the surface of the working roller is also suitable as a process parameter for determining the lubrication requirement.

The relative speed between the contact surface of the rollable material and the surface of the working roller at a reference location can be computed, for example, from a momentary angular speed and a radius of the working roller, a spacing of the reference location from the rolling gap, the thicknesses of the rollable material ahead of and behind the rolling gap, and a rollable material speed ahead of or behind the rolling gap, cf. to this end, for example, equation (3.13) on page 113 in H. Hoffmann, R. Neugebauer and G. Spur (publishers), "Handbuch Umformen" ("Manual of forming"), 2nd edition, Carl Hanser Verlag, 2012, ISBN 978-3-446-42778-5. The relative speed between the contact surface of the rollable material and the surface of the working roller at a reference location can thus be at least approximately determined from the variables mentioned which can be readily determined by measurements and are in most instances detected anyway.

Taking into account the process parameters mentioned when determining the lubrication requirement by way of an additional lubrication that is adapted to the process parameters enables in particular the drive output required for the working rollers to be reduced, rollable material having a high compressive strength to be rolled, or else the total throughput of the rolling process to be increased by increasing the rollable material speed and/or by decreasing rolling interruptions by virtue of insufficient lubrication.

One further design embodiment of the invention provides that the cooling lubricant quantity introduced into the contact zone is set so as to depend on the at least one process parameter of the rolling process. By setting also the cooling lubricant quantity so as to depend on the at least one process parameter, it can be taken into account in particular that the additional lubrication reduces the rolling gap friction on account of which the heating of the working rollers and thus the cooling requirement also drop, and the cooling lubricant quantity used can thus be reduced in a corresponding manner.

Further design embodiments of the invention provide that a pure lubricant, for example a rolling oil, or a lubrication emulsion which has a higher lubricant proportion than the cooling lubricant, is used as the additive lubricant. According to these design embodiments, the additive lubricant has a higher lubricating effect than the coolant lubricant such that a relatively minor additive lubricant quantity already significantly increases the lubrication of the contact zone. The use of a lubricant emulsion instead of a pure lubricant as the additive lubricant can be advantageous when the additive lubricant, in addition to the lubricating effect, is also to have a cooling function for cooling the rollable material.

Further design embodiments of the invention provide that the additive lubricant is applied to the rollable material by spraying, and/or that the additive lubricant is applied to the contact surface of the rollable material uniformly across an entire rollable material width of the rollable material. These design embodiments of the invention advantageously enable a uniform distribution of the additive lubricant in the contact zone.

One further design embodiment of the invention provides that the additive lubricant is applied to the rollable material by an additional lubricating device which is independent of a cooling lubricating device for introducing the cooling lubricant into the contact zone. This design embodiment of the invention thus provides separation of the mechanisms for applying the cooling lubricant and the additive lubricant. This advantageously enables a flexible configuration of the entire cooling and lubricating complex for a roll stand as well as a simple retro-fitting capability of existing systems without having to perform any modifications on the cooling lubricating devices thereof for introducing a cooling lubricant.

One further design embodiment of the invention provides that the lubrication requirement of the contact zone is determined prior to the start of the rolling process and/or during the rolling process. Determining the lubrication requirement prior to the start of the rolling process enables lubrication of the contact zone that is adapted to the at least one process parameter already at the beginning of the rolling process. Determining the lubrication requirement during the rolling process enables the lubrication to be adapted to changes of the at least one process parameter that arise during the rolling process, for example to changes in the rollable material speed, the compressive strength, and/or the roughness of the rollable material.

One further design embodiment of the invention provides that the lubrication requirement of the contact zone is determined while using a Stribeck diagram for a coefficient of friction of the friction between the contact surface and the working roller in the contact zone, so as to depend on at least one process parameter. Stribeck diagrams of this type are known, for example, from J.B.A.F. Smeulders, "Lubrication in the Cold Rolling Process Described by a 3D Stribeck Curve", AISTech 2013 Proceedings, pp. 1681-1689. Determining a coefficient of friction of the friction between the contact surface and the working roller in the contact zone advantageously enables a quantitative determination of the lubrication requirement so as to depend on the coefficient of friction determined.

In particular for a roll stand, there is a strong dependence of the coefficient of friction (and thus of the drive output required for the working rollers) on the rollable material speed and the relative speed between the contact surface of the rollable material and the surface of the working roller, that dependence being able to be described by way of a three-dimensional Stribeck diagram for the coefficient of friction as a function of the rollable material speed and the relative speed. The specific form of this function herein depends on the lubricating properties of the system, in particular on the properties of the lubricant per se, the adhesion of the latter on the rollable material surface, and the roughness of the rollable material. The roll stand by means of this function can be assigned an operative point which determines the coefficient of friction of the roll stand for the respective values of the rollable material speed and the relative speed between the contact surface of the rollable material and the surface of the working roller while taking into account the lubricating properties of the system. This enables a very discriminating determination of the lubrication requirement of the contact zone that is adapted to the specific lubricating properties of the system, depending on the rollable material speed and the relative speed between the contact surface of the rollable material and the surface of the working roller, on account of which a more targeted lubrication can be set in order for the rolling process to be optimized, for example in terms of the throughput rate of the rollable material, the wear on the working rollers, the consumption of lubricant and cooling lubricant, and/or the drive output required for the working rollers.

One further design embodiment of the invention provides that the additive lubricant is applied to two mutually opposite contact surfaces of the rollable material. Mutually dissimilar additive lubricant quantities of the additive lubricant can be applied herein to the two contact surfaces of the rollable material. The application of the additive lubricant to both contact surfaces of the rollable material advantageously enables a mutually adapted lubrication of both contact zones of the rollable material by way of the working rollers. The application of mutually dissimilar additive lubricant quantities of the additive lubricant to the two contact surfaces in particular enables distribution of torque between the working rollers to be influenced and to be optimized.

The properties, features, and advantages of the invention described above, and the manner in which the properties, features, and advantages are achieved will become more evident and more clearly understandable in the context of the following description of exemplary embodiments which are explained in more detail in conjunction with the drawings, in which:

DESCRIPTION OF AN EMBODIMENT

Equivalent parts are provided with the same reference signs in the figures.

Figure 1:
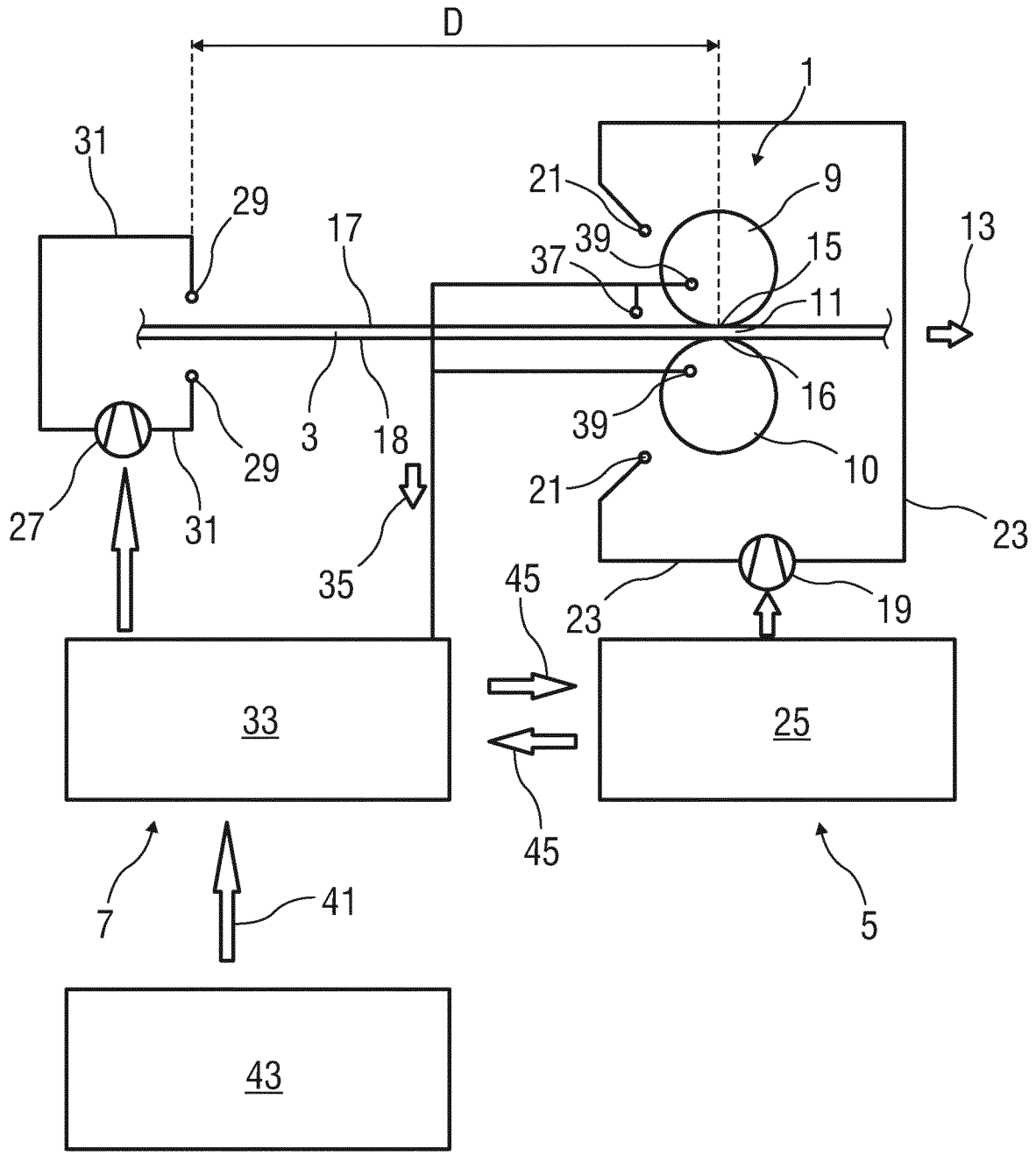
FIG. 1 shows a block diagram of a roll stand, of a cooling lubricating device, and of an additional lubricating device.

FIG. 1 shows a block diagram of a roll stand 1 for rolling a rollable material 3, a cooling lubricating device 5 and an additional lubricating device 7. The rollable material 3 is a metallic rolled strip, for example a steel strip, and the thickness of the strip is reduced by the rolling.

The roll stand 1 has two working rollers 9, 10 which are disposed one on top of the other and which are mutually spaced apart by a rolling gap 11. In order for the rollable material 3 to be rolled, the working rollers 9, 10 are set in rotation, and the rollable material 3 is drawn by the rotating working roles 9, in a rolling direction 13 through the rolling gap 11. In the region of the rolling gap 11, the rollable material 3 herein is in contact with the working rollers 9, 10 in two contact zones 15, 16, wherein an upper contact surface 17 of the rollable material 3 contacts the upper working roller 9 in a first contact zone 15, and a lower contact surface 18 of the rollable material 3 contacts the lower working roller 10 in a second contact zone 16.

A cooling lubricant is introduced into the contact zones 15, 16 by way of the cooling lubricating device 5. The cooling lubricant is a cooling lubricant emulsion which is composed of a cooling liquid and a lubricant, for example of water as the cooling liquid and oil as the lubricant, as well as potentially of emulsifiers. The main component of the cooling lubricant emulsion herein is the cooling liquid, while the lubricant proportion of the cooling lubricant is only a few percent, for example two to three percent.

The cooling lubricating device 5 comprises a cooling lubricant pump 19, at least one cooling lubricant spray beam 21 for each working roller 9, 10, cooling lubricant lines 23, and a cooling lubrication controller 25. Each cooling lubricant spray beam 21 comprises cooling lubricant nozzles for dispensing cooling lubricant to the respective working roller 9, 10. The cooling lubricant is pumped by the cooling lubricant pump 19 through the cooling lubricant lines 23 to the cooling lubricant spray beams 21 and by way of the cooling lubricant spray beams 21 is sprayed onto the working rollers 9, 10. The cooling lubricant quantities that are in each case dispensed by the cooling lubricant spray beams 21 are set by the cooling lubrication controller 25 by actuating the cooling lubricant pump 19. Cooling lubricant that is sprayed onto the working rollers 9, 10 is transported to the contact zones 15, 16 on account of the rotation of the working rollers 9, 10.

An additive lubricant can be applied to the rollable material 3 by way of the additional lubricating device 7. The additive lubricant is a pure lubricant, for example a rolling oil, or a lubricant emulsion made of a carrier liquid and a lubricant, for example water as the carrier liquid and rolling oil as the lubricant, wherein the lubricant proportion of the additive lubricant is higher than the lubricant proportion of the cooling lubricant, and is approximately 20%, for example.

The additional lubricating device 7 comprises an additive lubricant pump 27, in each case at least one additive lubricant spray beam 29 for each contact surface 17, 18 of the rollable material 3, additive lubricant lines 31, and an additional lubrication controller 33. Each additive lubricant spray beam 29 has additive lubricant nozzles for dispensing additive lubricant onto the respective contact surface 17, 18. The additive lubricant is pumped by the additive lubricant pump 27 through the additive lubricant lines 31 to the additive lubricant spray beams 29 and is sprayed onto the contact surfaces 17, 18 by way of the additive lubricant spray beams 29. The additive lubricant quantities A that are in each case dispensed by the additive lubricant spray beams 29 are set by the additional lubrication controller 33 by actuating the additive lubricant pump 27. Additive lubricant that is sprayed onto the contact surfaces 17, 18 is transported to the contact zones 15, 16 on account of the movement of the rollable material 3.

With regard to the rolling direction 13, the additive lubricant spray beams 29 herein are disposed ahead or upstream of the rolling gap 11 at a predefined application spacing D, in order for the additive lubricant to be applied to the rollable material 3 at this application spacing D ahead of the rolling gap 11. As a result, the additive lubricant acts on the contact surfaces 17, 18 of the rollable material 3 until the additive lubricant or the surfaces 17, 18 reaches the rolling gap 11. Adhesion of the additive lubricant to the contact surfaces 17, 18 is enhanced during this dwell time. On account thereof, the lubricating effect (the so-called plate-out) of the additive lubricant in the contact zones 15, 16 is advantageously improved as compared to an application of the additive lubricant to the contact surfaces 17, 18 directly ahead of the rolling gap 11.

In order for the additive lubricant quantities A to be applied to the contact surfaces 17, 18 to be set, a lubrication requirement for each contact zone 15, 16 is determined so as to depend on at least one process parameter of the rolling process. A rollable material speed v of the rollable material 3 is used herein as a process parameter. The rollable material speed v herein is determined, for example, by the additional lubrication controller 33 from measuring signals 35 of a strip speed sensor 37 that are supplied to the additional lubrication controller 33, said strip speed sensor 37 detecting a strip speed of the rolled strip. Material properties 41 of the respective rollable material 3, for example a compressive strength, and/or a roughness of the rollable material 3 are optional further process parameters for determining the lubrication requirement, the optional further process parameters being supplied as material property data 41 to the additional lubrication controller 33 by a production system 43.

Furthermore, relative speeds between the contact surfaces 17, 18 of the rollable material 3 at established reference locations and the surfaces of the working rollers 9, 10 can optionally be used as process parameters for determining the lubrication requirement. The relative speeds can be determined, for example, from the rollable material speed v at a reference location and from measuring signals 35 of rotation speed sensors 39 for detecting the revolutions of the working rollers 9, 10, and from the thicknesses of the rollable material 3 ahead of and behind the rolling gap 11, cf. to this end, the equation (3.13) on page 113 in H. Hoffmann, R. Neugebauer and G. Spur (publishers), "Handbuch Umformen" ("Manual of forming"), 2nd edition, Carl Hanser Verlag, 2012, ISBN 978-3-446-42778-5. A viscosity of the cooling lubricant, and/or a thickness of the rollable material 3 are further optional process parameters for determining the lubrication requirement. If necessary, the respective cooling lubricant quantities C that are currently present in the contact zones 15, 16 and/or the lubricant proportion of the cooling lubricant can furthermore be recorded and be used as process parameters. Moreover, control data 45 can be exchanged between the cooling lubrication controller 25 and the additional lubrication controller 33, in order for the settings of the cooling lubricant quantities C and the additive lubricant quantities A to be adjusted with respect to each other.

The additive lubricant is applied to each contact surface 17, 18 so as to depend on the lubrication requirement determined for the contact zones 15, 16 of the contact surface 17, 18 when the cooling lubricant quantity C currently introduced into the contact zones 15, 16 does not cover the lubrication requirement determined for the contact zone 15, 16, for example because a rollable material speed v changes or a rollable material 3 having an increased compressive strength is being rolled. The cooling lubricant quantities C applied to the working rollers 9, 10 herein are either kept constant or likewise set so as to depend on the at least one process parameter of the rolling process, and/or on the additive lubricant quantities A applied to the contact surfaces 17, 18, cf. to this end the description pertaining to FIG. 2.

Figure 2:
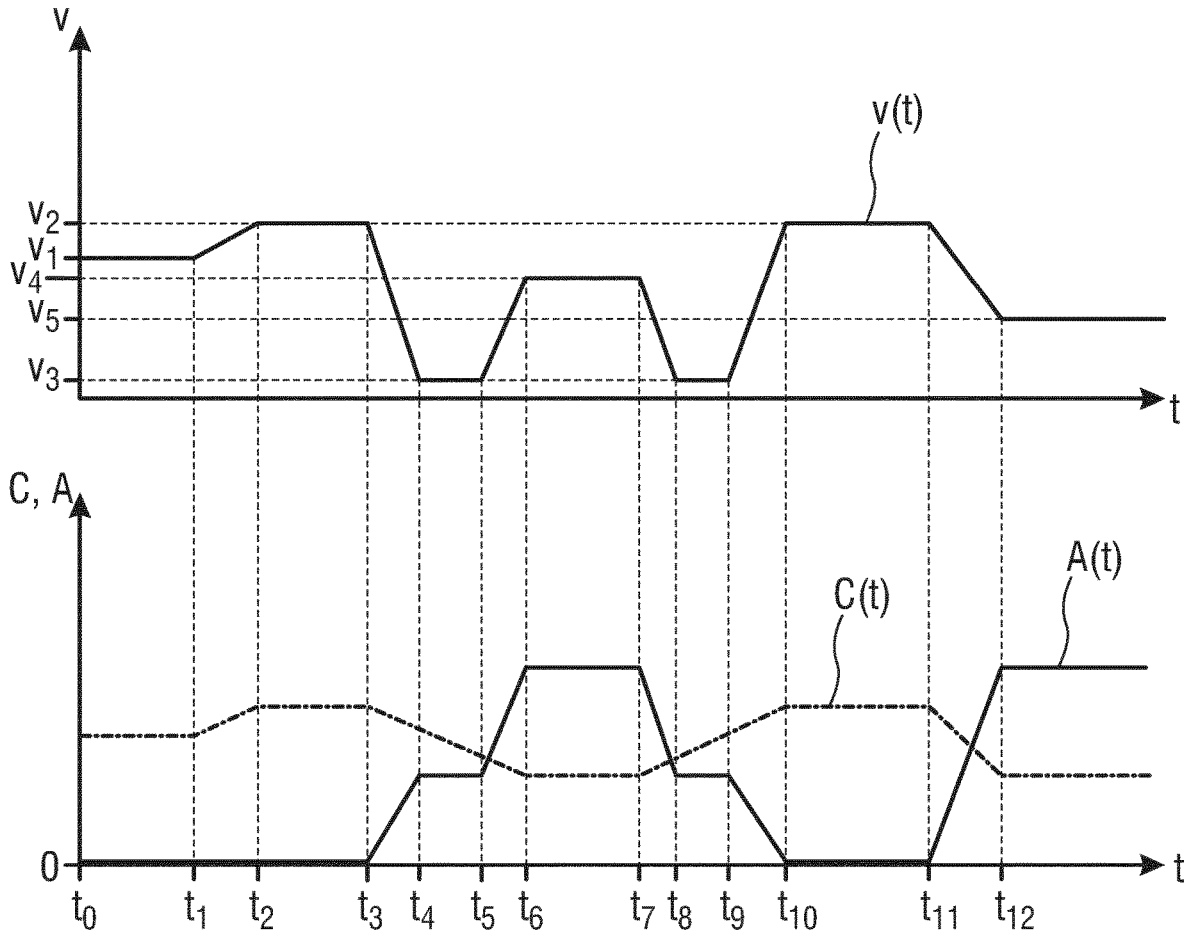
FIG. 2 shows temporal profiles of a rollable material speed, of a cooling lubricant quantity, and of an additive lubricant quantity.

FIG. 2 illustrates a method for rolling a rollable material 3, having a roll stand 1, a cooling lubricating device 5, and an additional lubricating device 7, the devices being configured according to FIG. 1. To this end, FIG. 2, in a manner depending on a time t, shows profiles v(t), C(t), A(t) of a rollable material speed v of the rollable material 3, of a cooling lubricant quantity C which by way of the cooling lubricating device 5 is applied to a working roller 9, 10 of the roll stand 1, and of an additive lubricant quantity A, which by way of the additional lubricating device 7, is applied to a contact surface 17, 18 of the rollable material 3 that contacts the working roller 9, 10 in a contact zone 15, 16. The cooling lubricant quantity C and the additive lubricant quantity A herein are in each case defined as a volume that is applied per unit of time.

FIG. 2 shows a case in which the rollable material 3 is composed of different rolled part-strips which are welded to one another. A first rolled part-strip herein is initially rolled between the temporal points to and $t_4$. Subsequently a first transition region between the first rolled part-strip and a second rolled part-strip having a first weld seam that connects the two rolled part-strips is rolled between the temporal points $t_4$ and $t_5$. Subsequently, the second rolled part-strip is rolled between the temporal points $t_5$ and $t_8$. Subsequently, a second transition region between the second rolled part-strip and a third rolled part-strip having a second weld seam that connects the two rolled part-strips is rolled between the temporal points $t_8$ and $t_9$. Subsequently, the third rolled-part strip is rolled as from the temporal point $t_9$. The second rolled part-strip herein has a higher compressive strength than the first rolled part-strip and the third rolled part-strip, the two latter having the same compressive strength.

The cooling lubricant quantity C and the additive lubricant quantity A herein are in each case set by the cooling lubrication controller 25 and the additional lubrication controller 33 so as to depend on a lubrication requirement which for the contact zones 15, 16 is determined so as to depend on the rollable material speed v and on the compressive strength of the respective part-strip, and optionally on further process parameters mentioned above. In order for the lubrication requirement to be determined, for example a so-called Stribeck diagram for a friction coefficient of the friction between the contact surface 17, 18 and the working roller 9, 10 in the contact zone 15, 16 so as to depend on the process parameters is used, such as is known, for example, from J.B.A.F. Smeulders, "Lubrication in the Cold Rolling Process Described by a 3D Stribeck Curve", AISTech 2013 Proceedings, pp. 1681-1689.

The first rolled part-strip between the temporal points to and $t_1$ is rolled at a first rollable material speed $v_1$. The rollable material speed v between the temporal points $t_1$ and $t_2$ is increased to a second rollable material speed $v_2$. The second rollable material speed $v_2$ is maintained up to the temporal point $t_3$. The lubrication requirement between the temporal points to and $t_3$ can be covered solely by the cooling lubricant such that no additive lubricant is applied. The increase of the rollable material speed v from the first rollable material speed $v_1$ to the second rollable material speed $v_2$ increases the lubrication requirement. The increased lubrication requirement is covered by a corresponding increase of the cooling lubricant quantity C.

The rollable material speed v between the temporal points $t_3$ and $t_4$ is heavily reduced from the second rollable material speed $v_2$ to a third rollable material speed $v_3$, in order to prepare the rolling of the first transition region between the first rolled part-strip and the second rolled part-strip comprising the first weld seam. The first transition region thereafter, between the temporal points $t_4$ and $t_5$, is rolled at the third rollable material speed $v_3$. Subsequently, the rollable material speed v between the temporal points $t_5$ and $t_6$ is increased to a fourth rollable material speed $v_4$ at which the second rolled part-strip is rolled between the temporal points $t_6$ and $t_7$.

The lubrication requirement for the rolling of the first transition region herein is increased in relation to the lubrication requirement for the rolling of the first rolled part-strip because of the very low third rollable material speed $v_3$. The lubrication requirement for the rolling of the second rolled part-strip is even higher than the lubrication requirement for the rolling of the first transition region due to the high compressive strength of the second rolled part-strip. Therefore, additive lubricant is applied as from the temporal point $t_3$, wherein a larger additive lubricant quantity A is applied for the rolling of the second rolled part-strip between the temporal points $t_6$ and $t_7$ than for the rolling of the first transition region between the temporal points $t_4$ and $t_5$. The cooling lubricant quantity C applied between the temporal points $t_3$ and $t_6$ is simultaneously decreased and kept constant between the temporal points $t_6$ and $t_7$, in order for any washing-off of applied additive lubricant by the cooling lubricant to be prevented or reduced, respectively.

The rollable material speed v between the temporal points $t_7$ and $t_8$ is again decreased from the fourth rollable material speed $v_4$ to the third rollable material speed $v_3$, in order to prepare the rolling of the second transition region between the second rolled part-strip and the third rolled part-strip comprising the second weld seam. The second transition region thereafter, between the temporal points $t_8$ and $t_9$, is rolled at the third rollable material speed $v_3$. Subsequently, the rollable material speed v between the temporal points $t_9$ and $t_{10}$ is increased to the second rollable material speed $v_2$ at which the third rolled part-strip is rolled between the temporal points $t_{10}$ and $t_{11}$.

Accordingly, the additive lubricant quantity A applied is first decreased for the rolling of the second transition region, and no additive lubricant at all is applied for the rolling of the third rolled part-strip at the second rollable material speed $v_2$. Concurrently, the applied cooling lubricant quantity C is increased again.

The rollable material speed v between the temporal points $t_{11}$ and $t_{12}$ is decreased from the second rollable material speed $v_2$ to a fifth rollable material speed $v_5$ at which the third rolled part-strip is rolled as from the temporal point $t_{12}$.

The rolling of the third rolled part-strip at the fifth rollable material speed $v_5$ necessitates a lubrication requirement which cannot be covered solely by the cooling lubricant. Therefore, additive lubricant is again applied for the rolling of the third rolled part-strip at the fifth rollable material speed $v_5$, and the cooling lubricant quantity C applied is simultaneously reduced, wherein the additive lubricant quantity A and the cooling lubricant quantity C applied are mutually tuned such that the lubrication requirement is covered and any washing-off of applied additive lubricant by the cooling lubricant is prevented or reduced, respectively.

Figure 3:
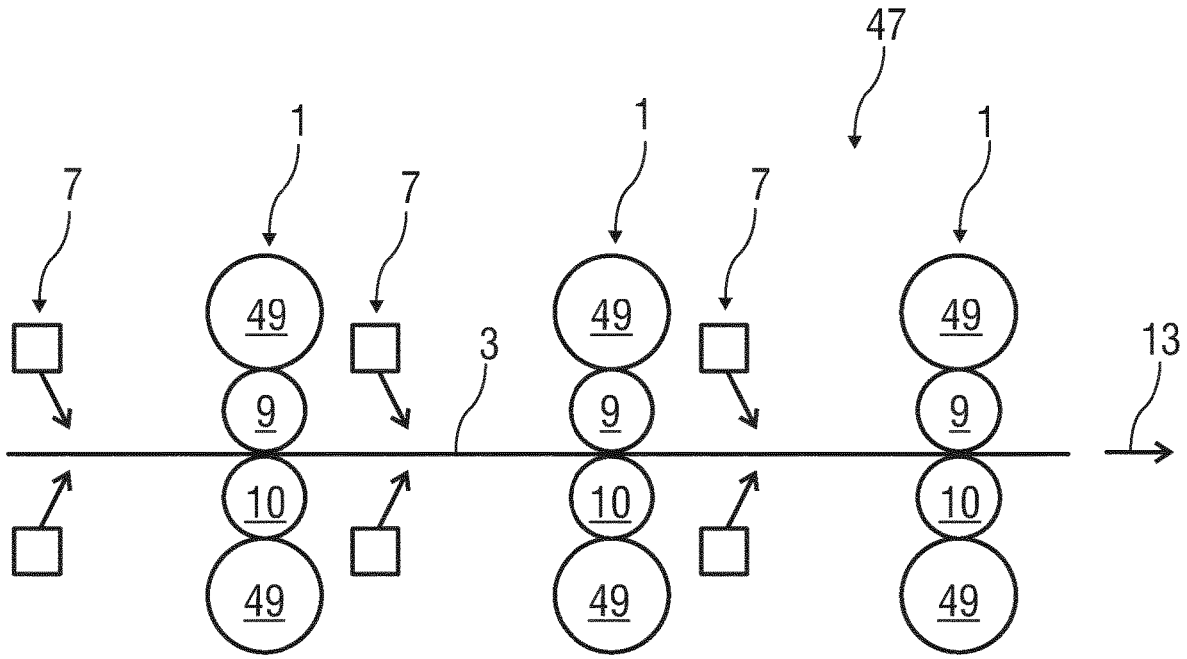
FIG. 3 schematically shows a rolling line of a rolling mill.

FIG. 3 schematically shows a rolling line 47 of a rolling mill, having a plurality of roll stands 1 disposed behind one another for rolling a rollable material 3. The roll stands 1 have in each case two working rollers 9, 10 that are disposed one on top of the other, and have one support roller 49 for each working roller. For each roll stand 1, the rolling line 47 comprises one cooling lubricating device 5 (not illustrated in FIG. 3) and one additional lubricating device 7. The cooling lubricating devices 5 are in each case configured like the cooling lubricating device 5 illustrated in FIG. 1, and the additional lubricating devices 7 are in each case configured like the additional lubricating device 7 illustrated in FIG. 1, wherein, with regard to the rolling direction 13, the additive lubricant spray beams 29 of each additional lubricating device 7 are disposed at the application spacing D ahead of the rolling gap 11 of the associated roll stand 1.

While the invention has been illustrated and described in detail by way of preferred exemplary embodiments, the invention is not limited by the disclosed examples, and other variations can be derived herefrom by a person skilled in the art without departing from the scope of protection of the invention.

The invention claimed is:

1. A method for rolling a rollable material, comprising:

rolling the rollable material in a rolling direction and guiding the rollable material through a rolling gap between two working rollers of a roll stand;

in a contact zone, in which a contact surface of the rollable material contacts at least one of the working rollers, introducing a cooling lubricant for lubricating the contact zone on the rollable material then at the contact zone;

determining a lubrication requirement of the contact zone, wherein the lubrication requirement depends on at least one process parameter of the rolling method;

using at least one of a group consisting of a rollable material speed of the rollable material, a compressive strength of the rollable material, a roughness of the rollable material, a relative speed between the contact surface of the rollable material at a reference location and the surface of the working roller, a thickness of the rollable material, and a viscosity of the cooling lubricant as the at least one of the process parameters for determining the lubrication requirement;

setting a quantity of an additive lubricant applied to the contact surface of the rollable material wherein the quantity of the additive lubricant depends on the lubrication requirement determined for the contact zone;

applying the quantity of the additive lubricant to the contact surface of the rollable material ahead of the rolling gap in the rolling direction at a predefined application spacing from the rolling gap only when a quantity of the cooling lubricant that is currently introduced into the contact zone does not cover the lubrication requirement, and an application spacing ahead of the rolling gap is dimensioned such that an adhesion of the additive lubricant on the contact surface is increased; and reducing the quantity of the cooling lubricant introduced into the contact zone when additive lubricant is applied to the contact surface.

2. The method as claimed in claim 1, further comprising setting the cooling lubricant quantity introduced into the contact zone to depend on the at least one process parameter of the rolling process.

3. The method as claimed in claim 1, wherein a pure lubricant is used as the additive lubricant.

4. The method as claimed in claim 1, wherein the additive lubricant comprises a lubricant emulsion which has a higher lubricant proportion than the cooling lubricant.

5. The method as claimed in claim 1, wherein the step of applying the additive lubricant to the rollable material comprises spraying the additive lubricant.

6. The method as claimed in claim 1, wherein the step of applying the additive lubricant to the contact surface of the rollable material comprises uniformly supplying the additive lubricant to the contact surface across an entire rollable material width of the rollable material.

7. The method as claimed in claim 1, wherein the step of applying the additive lubricant to the rollable material comprises using an additional lubricating device which is independent of the introducing of the cooling lubricant for introducing the cooling lubricant into the contact zone.

8. The method as claimed in claim 1, wherein the step of determining the lubrication requirement of the contact zone occurs prior to the start of the step of rolling or during performance of the method of rolling.

9. The method as claimed in claim 1, wherein the determining of the lubrication requirement of the contact zone comprises using a Stribeck diagram for a coefficient of friction of the friction between the contact surface and the working roller in the contact zone to depend on at least one process parameter.

10. The method as claimed in claim 1, wherein the rollable material has two mutually opposite contact surfaces, and wherein the additive lubricant is applied to the two mutually opposite contact surfaces of the rollable material.

11. The method as claimed in claim 10, wherein the step of applying the additive lubricant comprises applying mutually dissimilar additive lubricant quantities to the two contact surfaces of the rollable material.

* * * * *